United States Patent [19]

Askerneese

[11] Patent Number: 4,979,629

[45] Date of Patent: Dec. 25, 1990

[54] AIR EXPELLER AND SUPPLY RECEPTACLE FOR NURSING BOTTLE

[76] Inventor: Bonnie L. Askerneese, 502 Del Oro Ct., Suisun, Calif. 94581

[21] Appl. No.: 464,008

[22] Filed: Jan. 12, 1990

[51] Int. Cl.[5] ..... A61J 9/00; A61J 9/06

[52] U.S. Cl. ..... 215/11.1; 215/11.3; 215/11.6; 215/100 R; 215/100 A; 222/95

[58] Field of Search ..... 215/11.1, 11.3, 11.6, 215/100 R, 100 A, 6; 222/95, 386

[56] References Cited

U.S. PATENT DOCUMENTS

| | | | |
|---|---|---|---|
| 2,876,113 | 3/1959 | Barton | 215/11.3 X |
| 3,627,161 | 12/1971 | Wergeland | 215/11.6 |
| 3,648,873 | 3/1972 | Grobbel | 215/11.3 |
| 3,955,698 | 5/1976 | Hammer | 215/11.3 |
| 3,998,348 | 12/1976 | Sammaritano | 215/11.3 |
| 4,176,754 | 12/1979 | Miller | 215/11.3 |
| 4,339,046 | 7/1982 | Coen | 215/11.3 X |
| 4,401,224 | 8/1983 | Alonso | 215/11.5 |
| 4,796,767 | 1/1989 | McKeown | 215/11.1 |
| 4,815,615 | 3/1989 | Phlaphongphanich | 215/11.1 |
| 4,821,896 | 4/1989 | Cheng | 215/11.5 |

*Primary Examiner*—Sue A. Weaver

*Attorney, Agent, or Firm*—Schapp and Hatch

[57] ABSTRACT

What is disclosed is an expeller for expelling air from a liner-type nursing bottle which at the same time provides unified storage for liners, a nipple, and premeasured portions of powdered infant formula. The apparatus of the invention further comprises a hand stop which can be engaged with the nursing bottle shell to prevent the mother's hand from slipping along the surface of the shell when the shell is drawn downwardly over the three-part apparatus of the invention to expel air from within the liner.

11 Claims, 1 Drawing Sheet

AIR EXPELLER AND SUPPLY RECEPTACLE FOR NURSING BOTTLE

BACKGROUND OF THE INVENTION

1. Field of the Invention.

My invention relates to nursing bottles, and more particularly to nursing bottles of the type which comprise a thin-walled shell which, during nursing, encloses a flaccid liner containing infant formula.

2. Description of the Prior Art.

In a conventional nursing bottle having rigid side walls both formula and air are present and are thus ingested by the feeding infant, which feels discomfort and distress to the presence of air in its stomach. The development of nursing bottles comprising thin-walled shells adapted to enclose a flexible liner which functions as the formula container was intended to alleviate if not completely eliminate the problem of air ingestion.

It was believed that as formula was drawn from the flexible liner the side walls of the liner would collapse about the remaining formula, thereby avoiding the creation of a partial vacuum within the bottle such as occurs in those bottles having rigid sides. It has been determined, however, that air will still be drawn into a nursing bottle having a flexible liner, especially after the contents are partially drawn out and the bottle is turned upright. Although the side walls of the liner do collapse, the tension exerted on the side walls by the weight of the formula at the bottom of the liner tends to separate the collapsed side walls, which generates a partial vacuum within the liner that draws air.

In response to this continuing problem, various devices have been developed to expel air from nursing bottles having flaccid liners Such devices will be called "expellers" herein.

These prior art expellers, however well adapted to the task of expelling air from the flexible liner, constitute one more item which must be carried by the mother, along with additional liners, powered formula, additional nipples, etc.; in addition, of course, to the nursing bottle shell and its associated cap.

Related Art. It is believed that the documents listed immediately below contain information which is or might be considered to be material to the examination of this patent application.

| Patent No. | Inventor |
|---|---|
| 3,648,873 | S. Grobbel |
| 3,955,698 | H. Hammer |
| 3,998,348 | M. Sammaritano |
| 4,339,046 | R. Coen |
| 4,401,224 | F. Alonso |
| 4,796,767 | F. McKeown |
| 4,821,896 | P. Cheng |

The term "prior art" as used herein or in any statement made by or on behalf of applicant means only that any document or thing referred to as prior art bears, directly or inferentially, a date which is earlier than the effective filing date hereof.

SUMMARY OF THE INVENTION

Accordingly, it is an object of my invention to provide an expeller for nursing bottles of the type comprising a shell having a flaccid liner which functions as a formula container, which expeller also serves to provide storage space for said additional items, such as additional liners, additional nipples, and premeasured quantities of powdered formula.

Another object of my invention is to provide an expeller which can be frictionally engaged with the nursing bottle shell whereby to provide a unitary assembly including the bottle shell, the bottle cap, the nipple, extra liners, extra nipples, and sufficient powder for multiple chargings of the nursing bottle with formula.

Yet another object of my present invention is to provide an expeller which is comprised of a formula powder container having three separate compartments each of which is adapted to contain measured quantity of powdered formula, and is adapted for dispensing the individual measured quantities of powdered formula one at a time.

An additional object of my present invention is to provide detachable flange means which can be removably attached to a nursing bottle shell, whereby to prevent slippage of the user's hand along the outer surface of the bottle shell while thrusting the bottle shell downward to expel air from the liner with the assistance of the expeller.

Other objects of my invention will in part be obvious and will in part appear hereinafter.

My invention, accordingly, comprises the apparatus embodying features of construction, combinations of elements, and arrangements of parts, all as exemplified in the following disclosure, and the scope of the present invention will be indicated in the appended claims.

In accordance with a principal feature of my invention an air expeller for liner-type nursing bottles takes the form of a hollow piston which is adapted to store nursing supplies and equipment such as spare liners and nipples.

In accordance with a further principal feature of my invention the expeller of my invention is provided with an open end and a closed end, and the open end is provided with securing means for securing thereto a cover which covers the open end.

In accordance with yet another principal feature of my invention said cover is provided with an enlarged portion adapted to frictionally engage the outer end of the nursing bottle shell, whereby to retain the piston in the nursing bottle shell.

In accordance with another principal feature of my invention the expeller piston of my invention is provided with graduations whereby it is adapted to serve as a graduated beaker for use in preparing infant formula.

In accordance with an additional principal feature of my invention the piston cover thereof serves not only as a cover for the open end of the expeller piston but also serves as a cover for a powder container, which powder container is adapted to contain at least one premeasured portion of infant formula powder.

In accordance with yet another principal feature of my invention said piston cover is cup-shaped and is adapted to close-fittingly contain said powder container.

In accordance with a yet further principal feature of my invention said powder container and said piston cover are provided with securing means whereby said powder container may be secured to said piston cover when embraced thereby.

In accordance with another principal feature of my invention the expeller piston thereof is adapted to be joined to the piston cover, the powder container is adapted to be joined to the piston cover, and the piston cover is adapted to be joined to the nursing bottle shell, whereby the nursing bottle shell and its associated liner retaining cap and nipple, the expeller piston of my invention, its cover, and the powder container may be joined together into a unitary assembly which is convenient to carry and which contains spare liners, a spare nipple, and several portions of infant formula powder, each of which portions is of the correct volume for one feeding.

In accordance with an additional principal feature of my invention said powder container is internally subdivided into a plurality of compartments each of which is of at least sufficient volume to contain one portion of formula powder for a single feeding In accordance with another principal feature of my invention the partitions which separate said compartments are joined along a central axis of said powder container.

In accordance with another principal feature of my invention said powder container is covered by at least one rotatable cover which is itself provided with an aperture adapted for registration with any selected one at a time of said compartments, whereby the powder can be discharged from one only of said compartments at a time.

In accordance with a yet further principal feature of my invention said powder container is provided with substantially identical inner and outer rotatable covers, whereby all of said compartments can be closed by rotating the outer one of said rotatable covers until its aperture is out of registration with the aperture in the inner cover, and detents are provided for maintaining said inner and outer covers in a mutual juxtaposition in which their apertures are out of registration.

In accordance with a yet further principal feature of my invention a hand stop is provided with serves to prevent the user's hand from slipping along the outer surface of the nursing bottle shell when the expeller piston is being manually driven into the bottle shell to expel air from the liner contained therein, and said hand stop resiliently embraces the bottle shell and is provided with inwardly directed ears adapted to engage the liner viewing slots in the bottle shell.

For a fuller understanding of the nature and objects of my invention, reference should be had to the following detailed description, taken in connection with the accompanying drawings.

DESCRIPTION OF THE PREFERRED EMBODIMENT

Figure 1:
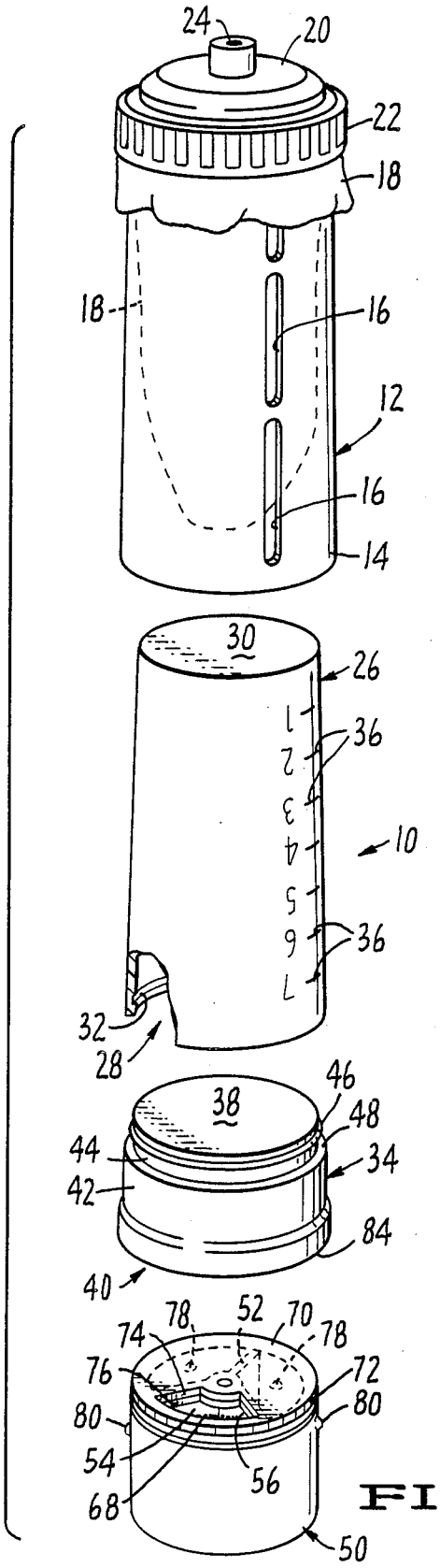
FIG. 1 is an exploded perspective view of the infant feeding assembly of my invention, including the expeller piston, the expeller piston cover, and powder container, and the associated nursing bottle.

Referring now to FIG. 1, there is shown the infant feeding assembly 10 of the preferred embodiment of my invention.

As seen in FIG. 1, infant feeding assembly 10 is comprised of a nursing bottle 12 of well known type. In the known manner, nursing bottle 12 is comprised of a thin-walled, rigid cylindrical shell 14 through which passes a plurality of liner viewing slots 16. The shell 14 of the nursing bottle 12 of the preferred embodiment of the invention is provided with three vertically aligned liner viewing slots 16, and is further provided with three additional vertically aligned liner viewing slots 16 at the opposite extremity thereof, i.e., such that a plane bisecting each of the two arrays of liner viewing slots 16 contains the axis of symmetry of shell 14.

Nursing bottle 12 further comprises a liner 18 of well known type the mouth portion of which is draped over the upper edge of shell 14 in the well known manner, a suitable cooperative nipple 20, and a cap 22 having a central opening in which nipple 20 is engaged and provided with threads adapted to coact with suitable threads formed in the upper end of shell 14 whereby to lock liner 18 in the position indicated in FIG. 1 and thus to form a leak-proof container the only access to which is through the openings 24 in the extreme upper end of nipple 20.

Referring again to FIG. 1, it will be seen that expeller piston 26 (sometimes called simply "piston") is provided with an open lower end 28 and a closed upper end 30.

As also there seen, piston 26 is provided at its lower end with a suitable groove 32 adapted to coact with a mating ridge in the upper end of its associate piston cover 34 in the manner described hereinafter.

In the preferred embodiment piston 26 is suitably formed from rigid, transparent plastic material, and is provided with graduations 36 whereby it may be inverted and used as a graduated beaker in preparing infant formula from powdered formula material of the well known type.

Figure 2:
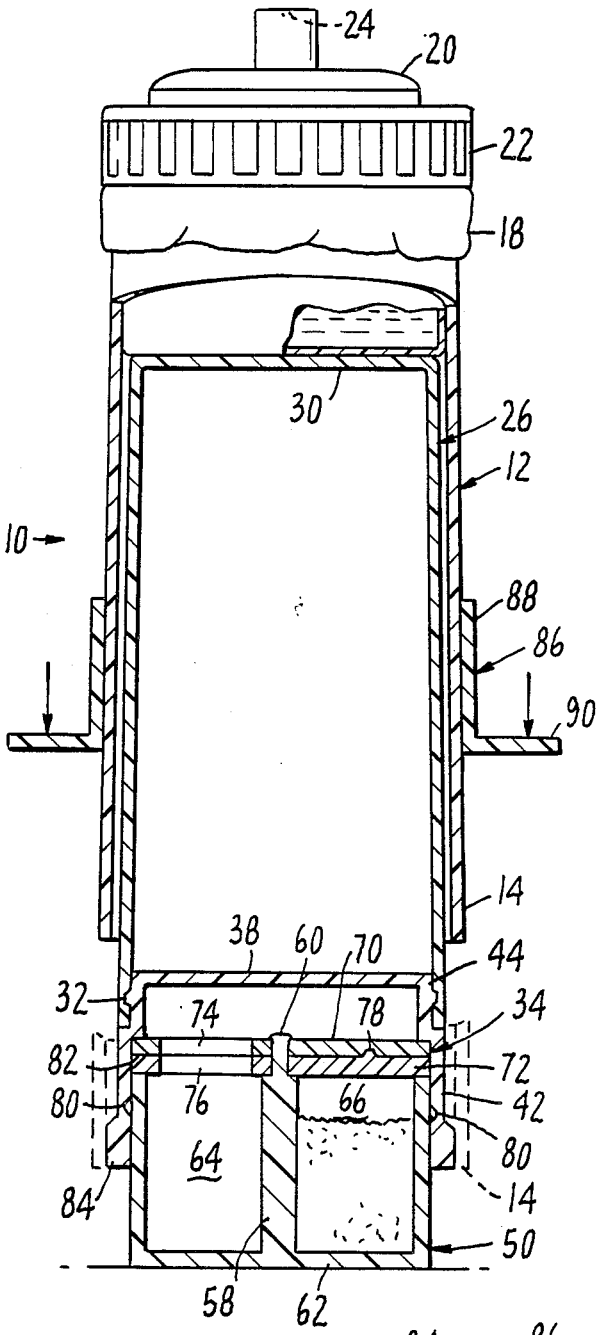
FIG. 2 is a vertical sectional view of an infant feeding assembly constructed in accordance with my invention.

In accordance with the principles of my invention the walls of piston 26 are sufficiently thick, and formed of such material, that piston 26 is sufficiently rigid so that it is not collapsed when used to expell air from liner 18 in the manner generally indicated in FIG. 2.

Referring now to FIG. 1, and comparing the same with FIG. 2, it will be seen that piston cover 34 is a concave member having a flat inner end 38 and an open outer end 40.

The outer, cylindrical wall of piston cover 34 is comprised of a major segment 42 and a minor segment 44.

The outer diameter of minor segment 44 is such that minor segment 44 is adapted to be close-fittingly received in the mouth 28 of piston 26. Minor segment 44 is provided with a ridge 46 adapted to be received in the inner groove 32 located near the mouth 28 of piston 26, and the material of piston 26 is sufficiently resilient so that piston cover 34 can be secured to piston 26 by manually forcing the mouth 28 of piston 26 over minor segment 44 of piston cover 34, as best shown in FIG. 2.

As may also be seen by comparison of FIGS. 1 and 2, piston cover 34 is provided with a shoulder 48 upon which the lip of piston 26 bears when piston cover 34 is secured to the mouth of piston 26 in the manner abovedescribed. Thus, it will be seen that the assembly of piston 26 and piston cover 34 may be used to carry out the air expelling function of piston 26 without removing piston cover 34 from piston 26 or removing the contents of piston 26, if such there be.

Referring again to FIG. 1, and comparing the same to FIG. 2, it will be seen that the powder container 50 of the preferred embodiment of my invention takes the form of a hollow cup the interior of which is divided into three separate compartments by vertical partitions 52, 54, and 56.

These three partitions are joined along the axis of symmetry of powder cup 50 into a unitary post member 58 (FIG. 2).

As best seen in FIG. 2, central post member 58 is surmounted by an integral stud member 60 the purpose of which will be explained hereinafter.

As best seen in FIG. 2, powder container 50 is closed at its lower end by an integral plate member 62, which closes the lower or inner ends of all three compartments 64, 66, and 68, which are separated by partitions 52, 54, and 56.

In view of the above, it will be understood by those having ordinary skill in the art informed by the present disclosure, that each of the compartments 64, 66, and 68 is capable of holding a premeasured quantity of infant formula powder of the well known type, such as indicated in FIG. 2 as being contained in compartment 66.

As may be further determined by comparison of FIGS. 1 and 2, powder container 50 is covered with two generally circular cover members 70, 72 which are both rotatably mounted on stud 60, and are removable from stud 60 by manual withdrawal from stud 60, due to the resiliency of the plastic material from which covers 70, 72 are fabricated.

It will also be seen that cover plates 70, 72 are provided, respectively, with wedge-shaped apertures 74, 76, which apertures are adapted to be brought in to registration, as seen in FIG. 1, by mutually relatively rotating the same about stud 60.

As will now be evident to those having ordinary skill in the art, informed by the present disclosure, cover plates 70, 72 may also be rotated about stud 60 into a relative juxtaposition wherein apertures 74, 76 are totally misregistered, in which position the powder, if such there be, in each compartment 64, 66, 68 is retained in that compartment.

Suitable button detents are provided whereby cover plates 74, 76 may be resiliently locked in aperture-registered or aperture-unregistered positions.

Referring now to FIG. 2, it will be seen that powder container 50 is close-fittingly receivable within major segment 42 of piston cover 34.

It will also be seen that powder container 50 is provided with button detents 80 whereby powder container 50 may be resiliently locked in piston cover 34 by manually forcing the open end of piston cover 34 over powder container 50 until outer cover 70 bears against inner shoulder 82 of piston cover 34.

Thus, it will be seen that the entire assembly of piston 26, piston cover 34, and powder container 50 may be used to expel air from liner 18 in the manner indicated in FIG. 2 without disassembling this three-part assembly or removing the feeding supplies or powder therefrom.

Again comparing FIGS. 1 and 2, it will be seen that the lower end of major segment 42 of piston cover 34 is provided with an outwardly depending ridge or flange 84.

As seen in FIG. 2, the lower end of shell 14 (shown in phantom) is adapted to frictionally engage ridge or flange 84 when assembly 26, 34, 50 is thrust into shell 14 to its maximum depth. This maximum engagement of assembly 26, 34, 50 can take place only when liner 18 is absent from nursing bottle 12.

As will now be understood by persons having ordinary skill in the art, informed by the present disclosure, the parts of assembly 26, 34, 50 of my invention can be mutually joined together into a single, unitary assembly, which assembly contains feeding supplies such as spare liners, a spare nipple, etc., and three premeasured quantities of infant formula powder.

As will further be evident to those having ordinary skill in the art, informed by the present disclosure, a nursing bottle 12 of the well known liner type made be thrust over and frictionally engaged with assembly 26, 34, 50, whereby to provide a unitary assembly of a nursing bottle, expeller, powder container, spare parts such as extra liners, and premeasured quantities of formula powder, thereby providing a most convenient means of organizing and carrying all of the feeding equipment and apparatus for an infant during a trip of several hours or the like, which apparatus may also be used, when disassembled, to measure the necessary water to be mixed with the powder, and to expel air from the liner of the nursing bottle during the feeding of the infant.

Figure 3:
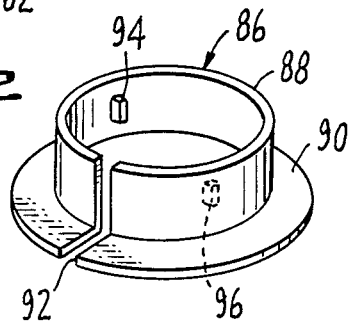
FIG. 3 is a perspective view of the hand stop of my invention.

Referring now to FIG. 3 there is shown the hand stop 86 of the preferred embodiment of my invention.

Hand stop 86 of the preferred embodiment is a single piece plastic molding comprising a generally cylindrical collar portion 88 and a unitary flange portion 90. A split 92 passes completely through collar 88 and flange 90.

On the inner surface of collar 88 are provided a pair of inwardly projecting ears 94, 96 which are adapted to pass through opposite viewing slots 16 of nursing bottle shell 14 when hand stop 86 is passed over bottle shell 14 and rotated until ears 94, 96 are thrust into the two middle slots 16 under the resilient urging of collar 88 and flange 90.

When hand stop 86 is thus engaged with bottle shell 14, and hand stop 86 is thrust downward as indicated by the arrows until ears 94 and 96 to engage the lower ends of the middle slots 16, hand stop 86 will be disposed upon bottle sleeve 14 in the position indicated in FIG. 2.

The purpose of hand stop 86 is to render easy and convenient the use of assembly 26, 34, 50 for expelling air from a liner 18 in nursing bottle 12, in the manner indicated in FIG. 2. That is to say, when nursing bottle 12 and assembly 26, 34, 50 are mutually interengaged as shown in FIG. 2, the mother feeding the infant need only grasp nursing bottle 12 with the lower portion of her hand surrounding collar 88 and contacting flange 90. When, with her hand thus engaged, the mother presses downwardly against flange 90 as indicated by the arrows in FIG. 2, she can conveniently force air out of the opening 24 in nipple 20 until one or two drops of formula emerge from opening 24, at which time the air will have been expelled from within liner 18.

It will thus be seen that the objects set forth above, among those made apparent from the preceeding description, are efficiently attained, and since certain changes may be made in the above constructions and the method carried out thereby without departing from the scope of my invention, it is intended that all matter contained in the above description or shown in the accompanying drawing shall be interpreted as illustrative only, and not in a limiting sense.

It is also to be understood that the following claims are intended to cover all of the generic and specific features of my invention hereindescribed, and all statements of the scope of my invention which, as a matter of language, might be said to fall therebetween.

What is claimed is:

1. An expeller for expelling air from the liner of a liner-type nursing bottle, comprising:

a hollow piston having an open end and a closed end and being dimensioned to be close-fittingly receivable within the shell of said nursing bottle;

cover means for covering said open end of said hollow piston, whereby to enclose infant feeding supplies within said hollow piston; and securing means for securing said cover means to said hollow piston in operative position at the open end thereof.

2. An expeller as claimed in claim 1 in which said hollow piston is translucent and is provided with graduations whereby it can serve as a graduated beaker in the preparation of infant formula.

3. An expeller as claimed in claim 1 in which said cover means is adapted to act as a pedestal for said hollow piston whereby said hollow piston may be erected on a flat surface and thus maintained in vertical position while said nursing bottle is engaged therewith and thrust thereonto to force air from the liner of said nursing bottle.

4. An expeller as claimed in claim 2 in which said cover means is adapted to act as a pedestal for said hollow piston whereby said hollow piston may be erected on a flat surface and thus maintained in vertical position when said nursing bottle is engaged therewith and thrust thereonto to force air from the liner of said nursing bottle.

5. An expeller as claimed, in claim 1, further comprising a formula powder container including means for engaging with said cover means and dimensioned to contain at least one premeasured portion of infant formula powder.

6. An expeller as claimed in claim 2, further comprising a formula powder container including means for engaging with said cover means and dimensioned to contain at least one premeasured portion of infant formula powder.

7. An expeller as claimed in claim 5 in which the interior of said powder container is subdivided by a plurality of partitions into a plurality of separate compartments and said powder container is provided with at least one rotatable cover for maintaining formula powder within said compartments.

8. The combination comprising:

a hollow piston dimensioned to be close-fittingly received within the shell of a liner-type nursing bottle and having an open end and a closed end;

a cover for said open end of said hollow piston;

securing means for securing said cover in place over the open end of said hollow piston; and, a formula powder container dimensioned to be received in an open end of said piston cover.

9. The combination claimed in claim 8, further comprising a liner-type nursing bottle in which at least said piston and a part of said piston cover are dimensioned to be frictionally engaged.

10. The combination claimed in claim 9, further comprising a hand stop resiliently embracing said bottle shell and having lugs which are dimensioned to be engaged with viewing slots in said shell.

11. A hand stop for use in expelling air from the liner of a liner-type nursing bottle, which hand stop is adapted to resiliently embrace the shell of said nursing bottle, is provided with lugs dimensioned to engage the viewing slots in said shell, and when operatively engaged with said shell and said viewing slots defines an outwardly projecting member projecting outwardly from said shell.

* * * * *